US007445878B2

(12) United States Patent
Koyama et al.

(10) Patent No.: US 7,445,878 B2
(45) Date of Patent: Nov. 4, 2008

(54) ELECTROSTATIC CHARGE IMAGE DEVELOPING TONER

(75) Inventors: Mikio Koyama, Kunitachi (JP); Kenji Hayashi, Hachioji (JP); Kazuya Isobe, Hachioji (JP); Yasuharu Saita, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 337 days.

(21) Appl. No.: 11/224,037

(22) Filed: Sep. 13, 2005

(65) Prior Publication Data

US 2006/0073401 A1 Apr. 6, 2006

(30) Foreign Application Priority Data

Oct. 5, 2004 (JP) ..... 2004-292323

(51) Int. Cl.
*G03G 15/20* (2006.01)

(52) U.S. Cl. ..... 430/108.1; 430/120.1

(58) Field of Classification Search ..... 430/108.4, 430/124.3, 124.1
See application file for complete search history.

(56) References Cited

U.S. PATENT DOCUMENTS 4,576,890 A 3/1986 Hosoi
4,933,249 A 6/1990 Mikami
6,569,592 B2 * 5/2003 Ishihara et al. ..... 430/124.32
2002/0055055 A1 * 5/2002 Nakamura et al. ..... 430/137.17
2003/0175043 A1 * 9/2003 Handa et al. ..... 399/111
2003/0190547 A1 10/2003 Kobayashi et al.
2005/0069802 A1 * 3/2005 Hirose et al. ..... 430/111.4

OTHER PUBLICATIONS

European Examination Report for European Patent Application No. 05108334 (EP 1645916 A2), Feb. 26, 2008.

* cited by examiner

*Primary Examiner*—John L Goodrow
(74) *Attorney, Agent, or Firm*—Finnegan, Henderson, Farabow, Garrett & Dunner, L.L.P.

(57) ABSTRACT

A toner for developing an electrostatic charge image comprising a compound represented by a following formula (1):

formula (1)

wherein X represents H or —CO—$R_4$; $R_4$ represents an alkyl group having 1 to 4 carbon atoms and the alkyl group may have a substituent; $R_1$ though $R_3$ independently represent an alkyl group having 10 to 30 carbon atoms and the alkyl group may have a substituent; and $R_1$ through $R_3$ may be either the same or different.

14 Claims, 3 Drawing Sheets

ELECTROSTATIC CHARGE IMAGE DEVELOPING TONER

TECHNICAL FIELD

The present invention relates to a toner for developing an electrostatic charge image, more specifically, the invention relates to a toner for developing an electrostatic charge image containing an ester compound having a specific structure as a releasing agent.

RELATED ART

Recently in the field of the image forming technology based on the electrophotographic method such as copiers and printers, a technology of a level causing a microdot image with 1200 dpi (in the present invention, "dpi" indicates the number of dots per 2.54 cm.) level to accurately reproduce has been required in accordance with the development of the digital technology.

In order to cause the microdot image to faithfully reproduce as described above, miniaturization of the diameter of a toner particle has been studied, and a chemical toner represented by a polymerization toner to which various types of controls can be applied in the manufacturing process has been attracted attention, and a toner with a small diameter for faithfully reproducing the microdot image has been able to be obtained (for example, see Patent Document 1).

On the contrary, as a method for fixing a toner image transferred on an image forming support body such as paper, the fixing method based on the contact fixing methods represented by the thermal roll fixing method and the thermal belt fixing method is widely used. However, the contact fixing method had a problem that a melting toner adhered onto a heat member and an offset phenomenon in which the toner having adhered on the heat member was transferred to the image forming support body could easily occur.

As the means for preventing the generation of the offset phenomenon, for example, there has been a method of adding a releasing property to the heart member by coating silicon oil on a surface of the heart member of a fixing device, however, the transfer material coated with silicon oil could not be available in writing with a writing tool such as a ball-point pen and had disadvantageous for using in business machines due to contamination by a volatile component within the silicon oil and other reasons.

To cope with the above problem, development of an oil-less toner in which the releasing property is added to the toner particle itself has been discussed, and a technology of adding a fixing improver for causing the releasing property to express within the toner particle has emerged. As the compound expressing the releasing property, for example, an oil-less chemical toner containing a compound such as the ester compound of higher fatty acid containing long chain hydrocarbon group has been developed (for example, see Patent Documents 2, 3). The appearance of the toner containing the ester compound as the releasing agent has greatly contributed to the development of the oil-less image formation technology.

Recently, for the image formation technology based on the electrophotographic method, influence to the environment in association with the image formation is considered and the reduction of the electric consumption of printers and copiers is likely to be thought in order to achieve the reduction of business costs in the office, so that as one of the measures, a technology of carrying out the fixing at a lower temperature than the current fixing temperature has been attracted attention. Further, because of the characteristic that the required number of sheets can be printed at required time, an image forming apparatus based on the electrophotographic method has been newly used in the field of shortrun printing.

Nevertheless, when the fixing was carried out at a lower temperature using the toner containing the above ester compound, the formed toner image was confirmed to have a tendency to easily peel from the transfer material. Further, when a large amount of printing was continuously carried out, such that a several hundred-thousand-sheet level of printing was repeated, the charge rising capability of the toner was tend to be degraded, so that the durability with which the charge rising did not vary even when a large amount of image formation was repeated has been required. As described above, there was a need to add a capability adequately satisfying the new movement and needs of the market to the oil-less toner.

[Patent Document 1] Japanese Patent Publication Laid-Open No. 2000-214629 (see Paragraph 0061 and other paragraphs)

[Patent Document 2] Japanese Patent Publication Laid-Open No. 2002-287405 (see Paragraph 0051 and other paragraphs)

[Patent Document 3] Japanese Patent Publication Laid-Open No. 2003-91101 (see Paragraph 0208 and other paragraphs)

The present invention is made in light of the above problems, and its object is to provide a toner which can exhibit good fixing performance under lower temperature and a broad fixable temperature region accompany good offset resistance, for developing an electrostatic image to express good adhesion property relative to a transfer material, wherein a toner image does not peel from the transfer material when, for example, the fixing is carried out even at a lower temperature such that a surface temperature of the transfer material is around 100° C.

In the present invention, the object is to further provide a toner for developing an electrostatic charge image having durability with which the charge rising capability of the toner does not vary even when, for example, a mass printing of a several hundred-thousand-sheet level is continuously carried out.

SUMMARY

It is therefore an object of the present invention to provide a toner for developing an electrostatic image comprising a compound represented by a following formula (1):

formula (1)

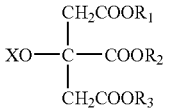

wherein X represents H or —CO—$R_4$; $R_4$ represents an alkyl group having 1 to 4 carbon atoms and the alkyl group may have a substituent; $R_1$ though $R_3$ independently represent an alkyl group having 10 to 30 carbon atoms and the alkyl group may have a substituent; and $R_1$ through $R_3$ may be either the same or different.

DESCRIPTION OF THE PREFERRED EMBODIMENT

Figure 1:
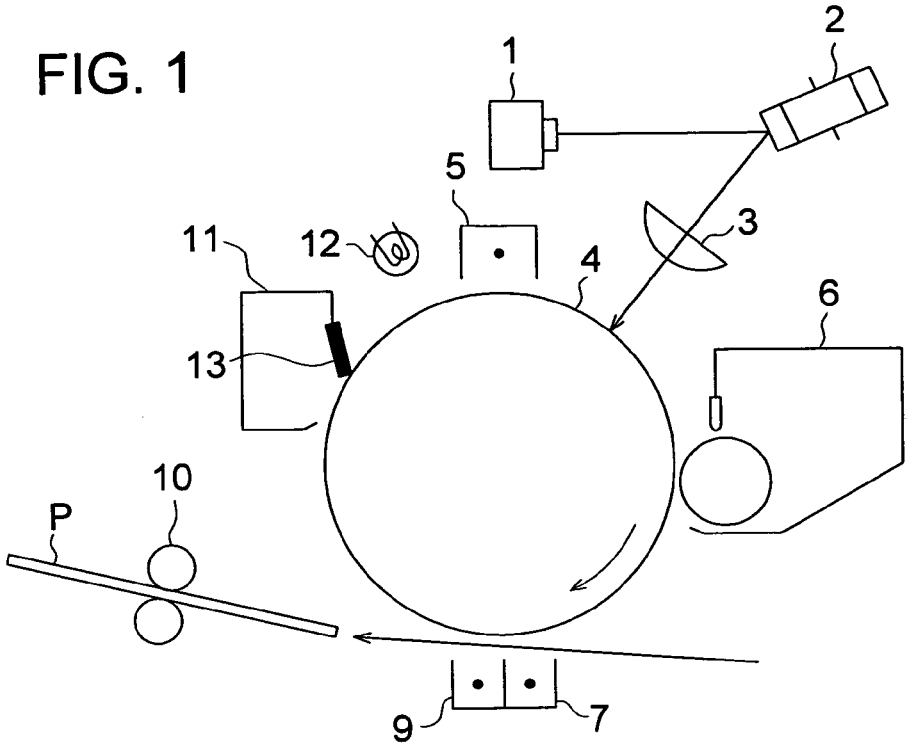
FIG. 1 is a cross-sectional configuration view showing an example of an image forming apparatus used in the present invention.

The present invention enabled provision of a toner for developing an electrostatic charge image expressing an excellent adhesion property relative to a transfer material, wherein a toner image does not peel from the transfer material even when, for example, the fixing is carried out at a lower temperature such that a surface temperature of the transfer material is around 100° C. with a toner for developing an electrostatic charge image containing a compound expressed by the above general formula (1).

The present invention further enabled provision of a toner for developing an electrostatic charge image with a higher durability with which an image having high density and no fog may be obtained when the toner of the present invention is used for the image formation such that, for example, a mass printing of a several hundred-thousand-sheet level is continuously carried out.

The present invention relates to a toner for developing an electrostatic charge image (also referred to only as a toner hereinafter) containing a compound expressed by the general formula (1). The present inventor found that when the toner containing a high fatty acid ester compound (also referred to as an ester compound having a specific structure hereinafter) expressed by the general formula (1) was used, for example, in an image forming apparatus for carrying out the fixing at a temperature such that a surface temperature of a transfer material was around 100° C., a toner image did not peel from the transfer material and expressed strong fixing capability.

Although the reason why, as described above, when the toner contained an ester compound having a specific structure, the strong fixing capability was expressed in the fixing even at a lower temperature is not clear, it is supposed that because of the existence of the ester group and the hydroxyl group which are short aliphatic hydrocarbons with a carbon number in the range of 1 through 4 within the ester compound structure, the ester compound became adequately oriented toward a cellulose molecule composing the transfer material, and as a result, the adhesion property between the transfer material and the toner was improved.

Further, when a mass printing of a several hundred-thousand-sheet level was continuously carried out using the toner of the present invention, the variation of the charge rising capability of the toner did not occur. The reason why when a large amount of continuous process was carried out with the toner containing an ester compound having a specific structure, the durability for keeping the charge rising capability was obtained is not clear, but the following reason may be thought. In a toner easily leave a large amount of water within the structure like a polymerization toner manufactured through the polymerization process within an aqueous medium, the ester compound has a structure in which a substituent having a high affinity to water such as an ester group linked with a hydroxyl group or a hydrocarbon radical with a smaller carbon number exists at the center of the molecule, so that the ester compound is supposed to take a structure which is easily oriented toward the water around the quaternary carbon which links to this substituent. Also, it is supposed that because of the existence of the ester compound in the state where the hydrophilic substituent is oriented outward, the charge rising effect is expressed on a surface of the toner particle by a polar radical within the ester compound.

As described above, in the toner of the present invention, it is supposed that because the ester compound having the above specific structure expressed an adequately orientation property relative to the cellulose molecule and water molecule, an excellent fixing capability was expressed in the fixing even at a lower temperature, so that the charge rising of the toner could be constantly kept even when a large amount of printing is continuously carried out.

Further, the toner of the present invention expresses an excellent releasing property, and the compound expressed by the general formula (1) contains several long-chain hydrocarbon radicals with a carbon number in the range of 10 through 30 due to the ester bond, so that a certain degree of affinity is expressed among ester compounds, the compound dispersing while forming a fine domain structure within the toner particle by this affinity action, thereby an excellent releasing property is supposed to be expressed.

The present invention will be described in detail below.

Toner of the present invention comprises at least a binder resin and a colorant, and further containing an ester compound having a specific structure.

The ester compound having a specific structure comprises an ester compound of citric acid having a long-chain aliphatic alcohol component which is expressed by the following a formula (1).

formula (1)

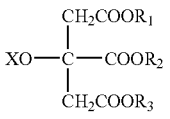

(In the general formula (1), X represents H or —CO—$R_4$; $R_4$ represents an alkyl group having 1 to 4 carbon atoms and the alkyl group may have a substituent; $R_1$ though $R_3$ each represent an alkyl group having 10 to 30 carbon atoms and the alkyl group may have a substituent, wherein $R_1$ through $R_3$ may be identical or different from each other.)

More specifically, the ester compound has three ester groups of long-chain aliphatic carbon hydride, and further contains an ester group of a short aliphatic carbon hydride or a hydroxyl group within the molecule.

The alkyl groups represented by $R_1$ through $R_4$ may have a substituent, preferably have no substituent. The substituent, for example, includes a sulfonic group, a nitro group, an amino group and a hydroxyl group.

Listed as the ester compound of the specific structure as described above are the following compounds (1) through (15).

(1)

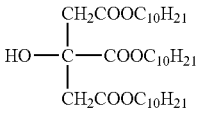

-continued (2)

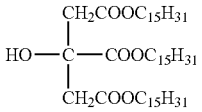

(3)

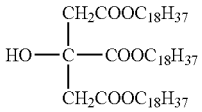

(4)

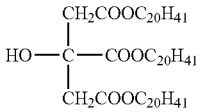

(5)

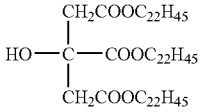

(6)

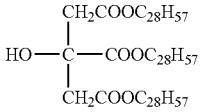

(7)

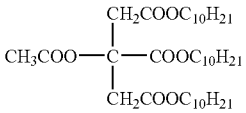

(8)

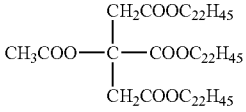

(9)

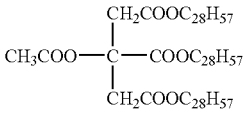

(10)

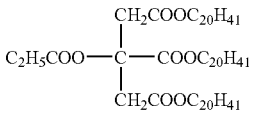

(11)

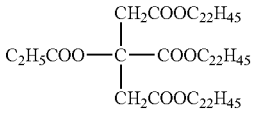

(12)

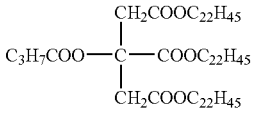

(13)

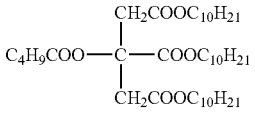

(14)

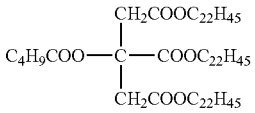

-continued (15)

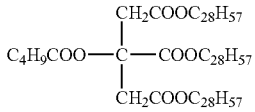

The ester compound of the specific structure may be produced by known methods, and the preferred method is, for example, that of producing by subjecting polyvalent carboxylic acid and higher (long-chain aliphatic) alcohol with a carbon number in the range of 10 through 30 to the dehydration condensation reaction.

The content (ratio) of the ester compound having the specific structure used in the present invention is preferably 1 through 15 parts by mass relative to 100 parts by mass of toner, and more preferably 3 through 12 parts by mass.

When the content of the ester compound having the specific structure is smaller than the above range, the releasing property and the charge property are likely to lower, and when the content of the ester compound having the specific structure is larger than the above range, the releasing effect and the charge rising function may be performed, while the adhesion property relative to the transfer material is somewhat likely to lower. Accordingly, it is possible to gain a broader fixable temperature region when the content is within the above range.

Furthermore the toner may include a plurality of compounds represented by formula (1).

Next, the method of manufacturing the toner of the present invention will be described below.

The toner of the present invention is preferably that obtained by at least polymerizing a polymerization monomer within an aqueous medium. This manufacturing method is that the polymerization monomer is polymerized based on the suspension polymerization method to prepare resin particles, or the monomer is emulsified and polymerized within a liquid added with an emulsified liquid of a required additive (within an aqueous medium) or is miniemulsified and polymerized to prepare fine resin particles in which charge control resin particles are added according to the necessity followed by a flocculant such as an organic solvent or a salt, to flocculate and fuse the resin particles.

(Suspension Polymerization Method)

An example of the method of manufacturing the toner of the present invention is as follows: a charge control resin is dissolved in the polymerization monomer in which various types of component materials such as a colorant or a releasing agent according to the necessity and a polymerization initiator are added, and then the various types of component materials are dissolved or dispersed in the polymerization monomer with a machine such as a homogenizer, a sand mill, a sand grinder, or an ultrasonic homogenizer. The polymerization monomer with the various types of component materials dissolved or dispersed therein is dispersed in the aqueous medium containing a dispersion stabilizer into oil droplets of a desired size as a toner using a machine such as a homomixer or a homogenizer. Subsequently, a stirring mechanism moves the resulting monomer to a reactor (a stirring device) which is a stirring blade described below to develop the polymerization reaction by heating. After the reaction is completed, the dispersion stabilizer is removed from the resulting system, and then filtered, rinsed, and dried to prepare the toner of the present invention. Incidentally, the "aqueous medium" in the present invention represents that containing a water content of at least 50% by mass or more.

(Emulsion Polymerization Method)

Further, another method of manufacturing the toner of the present invention may include a method of preparing the toner by subjecting resin particles to salting-out/fusion-bonding in the aqueous medium. Listed as this method, although not specifically limited, may be methods disclosed in, for example, Japanese Patent Publication Laid-Open No. HEI 5-265252, Japanese Patent Publication Laid-Open No. HEI 6-329947, and Japanese Patent Publication Laid-Open No. HEI 9-15904. Namely, the toner of the present invention may be formed by the method in which more than one of the dispersion particles of the component materials such as resin particles and a colorant, or fine particles composed of a resin and a colorant and the like are subjected to salting-out, flocculation and fusion-bonding, particularly after the particles are dispersed using these emulsifying agents in water, the resulting dispersion is added with a flocculating agent of the critical flocculation density or more to be subjected to salting-out, at the same time heat fusion-bonding at a temperature of the glass transition point of the formed polymer itself or more to form fusion particles while gradually growing the particle diameter, and the diameter growing is stopped at the time when the intended particle diameter is acquired by adding a large amount of water, wherein the particles further being heated and stirred to control the shape of the particle surface to be flat and smooth, and then heated and dried in the state of containing water and fluidity. Incidentally, at the same time of adding the flocculating agent, a solvent which is infinitely dissolvable to water such as alcohol may be added herein.

In the method of manufacturing the toner of the present invention, the preferred used method is that the ester compound having the specific structure is dissolved in the polymerization monomer and subsequently the compound resin fine particles and colorant particles which are formed through the process of polymerizing the polymerization monomer are subjected to salting-out/fusion-bonding. When the ester compound having the specific structure is melted in the polymerization monomer, the ester compound having the specific structure may be dissolved or fused.

Further, in the method of manufacturing of the toner of the present invention, the process of subjecting the compound resin fine particles obtained by the multistage polymerization method and the colorant particles to salting-out/fusion-bonding is preferably used.

Next, a preferred example of the method of manufacturing the toner (the emulsion aggregation method) will be described in detail.

This manufacturing method may include the following processes: (1) a dissolution process of dissolving the ester compound having the specific structure in a radical polymerization monomer; (2) a polymerization process of preparing a dispersion of resin fine particles; (3) a fusion-bonding process of fusing the resin fine particles in an aqueous medium to obtain toner particles (association particles); (4) a cooling process of cooling down the dispersion of the toner particles; (5) a cleaning process of subjecting the toner particles to solid-liquid separation from the cooled dispersion of the toner particles and removing a surface active agent and the like from the toner particles; (6) a dry process of drying the toner particles having been subjected to the cleaning treatment; and, according to the necessity, (7) a process of adding an external additive to the toner particles having been subjected to the dry treatment.

Now each of the processes will be described below.

[Dissolution Process]

This process is a process of dissolving the ester compound having the specific structure in the radical polymerization monomer to prepare a radical polymerization monomer solution of the ester compound having the specific structure.

[Polymerization Process]

In a preferred example of the polymerization process, liquid droplets of the radical polymerization monomer solution of the ester compound having the specific structure are formed in an aqueous medium (a solution of the surface active agent and radical polymerization initiator) to develop the polymerization reaction in the liquid droplets due to the radical from the radical polymerization initiator. Incidentally, an oil soluble polymerization initiator may be contained in the liquid droplets. In such a polymerization process, a treatment of forcibly emulsifying (forming liquid droplets) by applying mechanical energy is required. The means of applying the mechanical energy may include the means of applying the strong agitation or ultrasonic vibration energy such as a homo-mixer, ultrasonic waves, and Manton-Gaulin.

With the polymerization process, resin fine particles containing the ester compound having the specific structure and binder resin can be obtained. The resin fine particles may be colored fine particles or uncolored fine particles. The colored resin fine particles may be obtained by subjecting the monomer composition containing a colorant to the polymerization treatment. When the uncolored resin fine particles are used, a dispersion of the colorant fine particles is added to the dispersion of the resin fine particles in the fusion-bonding process described below, wherein the resin fine particles and the colorant fine particles are fusion-bonded to form the toner particles.

[Fusion-Bonding Process]

As the method of fusion-bonding in the fusion-bonding process, the salting-out/fusion-bonding method using the resin fine particles (colored or uncolored resin fine particles) obtained from the polymerization process is preferred. Further, in the fusion-bonding process, in addition to the resin fine particles and colorant fine particles, releasing agent fine particles and fine particles of an internal additive such as a charge control agent can be fusion bonded.

In the fusion-bonding process, the "aqueous medium" is referred to as that mainly of water (50% by mass or more). Listed as the components other than water may be organic solvents which dissolve in water including, for example, methanol, ethanol, isopropanol, butanol, acetone, methyl ethyl ketone, tetrahydrofuran. Of these, alcohols organic solvents such as methanol, ethanol, isopropanol, butanol which are the organic solvents not dissolving resins are particularly preferred.

The colorant fine particles can be prepared by dispersing a colorant in the aqueous medium. The dispersion treatment of the colorant is carried out in the state where the density of the surface active agent is set to the critical micelle density (CMC) or more in water. Although the homogenizer used for the colorant dispersion treatment is not specifically limited, preferably listed are the ultrasonic homogenizer, mechanical homogenizer, pressure homogenizers such as Manton-Gaulin and pressure type homogenizer, sand grinder, media type homogenizers such as Getzmann mill and diamond fine mill. Further, the surface active agent used herein may include that similar to the surface active agent as described above. Incidentally, the colorant (fine particles) may be subjected to surface modification. The surface modification method of the colorant is as follows: the colorant is dispersed in a solvent and the surface modification agent is added in the molecule mass liquid thereof, and then the resulting system is reacted by raising the temperature thereof. After the reaction is completed, the colorant is filtered and sorted, repeatedly cleaned and filtered with the same solvent, and then is dried to obtain a colorant (pigment) having been treated with the surface modification agent.

The salting-out/fusion-bonding method which is the preferred method is the process that the salting-out agent made of a metal salt such as an alkali metal salt or an alkaline earth metal salt is added as the flocculating agent of the critical flocculation density or more in the water in which resin fine particles and colorant fine particles exist, and subsequently the resulting solution is heated to a temperature which is equal to or greater than the glass transition point of the resin fine particle and is equal to or greater than the melting peak temperature (° C.) of the ester compound having the specific structure to develop salting-out, at the same time carrying out fusion-bonding. In this process, a method of effectively carrying out fusion-bonding by adding the organic solvent which is infinitely dissolvable in water to practically lower the glass transition temperature of the resin fine particle may be adopted. Listed herein as the alkali metal salt and alkaline earth metal salt which are the salting-out agents may be, lithium, potassium, sodium and the like for the alkali metals, magnesium, calcium, strontium, barium and the like for the alkaline earth metal salts, and preferably potassium, sodium, magnesium, calcium, barium. Listed as components of the salt may be chromic salt, bromine salt, iodine salt, carbonate, sulfate salt and the like. Further, listed as the organic solvents infinitely dissolvable in water may be methanol, ethanol, 1-propanol, 2-propanol, ethylene glycol, glycerin, acetone and the like, and preferably the alcohols of methanol, ethanol, 1-propanol, 2-propanol with a carbon number of 3 or less, and more preferably 2-propanol.

When the fusion-bonding is carried out by salting-out/fusion-bonding, a period of time for leaving the system after the salting-out agent is added is preferably as short as possible. Although the reason thereof is not clear, the following problems occur that depending on the leaving period of time after salting out, the flocculation state of the particles varies, so that the particle distribution is unstable and the surface property of the fusion bonded toner varies. Further, the temperature at which the salting-out agent is added is required to be at least equal to or smaller than the glass transition temperature of the resin fine particle. The reason thereof that when the temperature at which the salting-out agent is added is equal to or greater than the glass transition temperature of the resin fine particle, the salting-out/fusion-bonding of the resin fine particle is smoothly developed while the particle diameter cannot be controlled, so that the large diameter particles would be disadvantageously generated. The range of the additive temperature may be equal to or smaller than the glass transition temperature of the resin, generally in the range of 5 through 55° C., and preferably 10 through 45° C.

In the present invention, the salting-out agent is added at the glass transition temperature of the resin fine particle or less, and then the temperature is raised as fast as possible to heat to the temperature which is equal to or greater than the glass transition temperature of the resin fine particle as well as equal to or greater than the melting peak temperature (° C.) of the ester compound having the specific structure. The period of time of this temperature rise is preferably less than one hour. Further, the temperature rise must be carried out quickly, and the temperature rise speed is preferably 0.25° C./min or more. The upper limit is not specifically determined, however, when the temperature is immediately raised, the salting-out is rapidly developed and the particle diameter is difficult to be controlled, thereby 5° C./min or less is preferred. With this fusion-bonding process, a dispersion of the association particles (toner particles) comprising the resin fine particles and any fine particles being subjected to salting-out/fusion-bonding can be obtained. The glass transition temperature of the resin fine particle and the melting peak temperature of the ester compound having the specific structure can be measured by using DSC-7 (differential scanning calorimetry manufactured by Perkin Elmer, Inc.) and TAC7/DX (thermal analysis controller manufactured by Perkin Elmer, Inc.). The analysis procedure includes precise weighing a toner to be 4.5 mg to 5.0 mg to two places of decimals; enclosing the toner into an aluminum pan (Kit No. 0219-0041) and setting the pan on the sample-holder; and preparing a blank aluminum pan as a reference, wherein a measurement condition has a measurement temperature of 0-200° C., the temperature rise speed of 10° C./min and the temperature drop speed of 10° C./min. The temperature control is conducted so as to be $1^{st}$ heating, cooling and $2^{nd}$ heating, and the analysis is based on a data during the $2^{nd}$ heating. The glass transition temperature is temperature at the intersection point of (1) the extension line of a base line before the endoergic peak temperature of the resin fine particle and (2) the tangential line shown as the maximum inclination between rising part of the endoergic peak and the peak thereof. The melting peak temperature is indicated by a peak top temperature of the endoergic peak of the ester compound.

[Cooling Process]

This process is a process of subjecting the dispersion of the toner particles to the cooling treatment (quick cooling treatment). The condition of the cooling treatment is to cool at a cooling speed of 1 through 20° C./min. The method of the cooling treatment, although which is not specifically limited, may include a method of cooling by introducing a cooling medium from outside of a reaction container and a method of cooling by directly charging cool water into the reaction system.

[Solid-Liquid Separation and Cleaning Process]

In the solid-liquid separation and cleaning process, the following treatments are applied: a solid-liquid separation treatment of subjecting the toner particles to solid-liquid separation from the dispersion of the toner particles having been cooled down to a prespecified temperature in the above process; and a cleaning treatment of removing deposits such as the surface active agent and the salting-out agent from a toner cake (an aggregation substance with a cake-shape) having been subjected to solid-liquid separation. Herein, the filter treatment method, which is not specifically limited, may include the methods such as the centrifugal separation method, decompression filter method using Nutsche, and the filter method using a filter press.

[Dry Process]

This process is a process of subjecting the toner cake having been subjected to the cleaning treatment to the dry treatment to obtain dried toner particles. Listed as the dryer used in this process may be a spray dryer, a vacuum-freeze dryer, and a decompression dryer and the like, and it is preferred to use a stationary rack-dryer, a movable rack-dryer, a fluidized dryer, a rolling dryer, an agitation dryer and other dryers. The water content of the dried toner particle should be preferably 5% by mass or less, more preferably 2% by mass or less. Incidentally, when the toner particles having been subjected to the dry treatment are agglomerated with a small attraction force among the particles, the agglomeration may be subjected to the powder treatment. Herein, mechanical type of powder machines such as a jet-mill, a Henschel mixer, a coffee mill, a food processor and the like may be used as the powder treatment machine.

[External Additive Process]

This process is a process of manufacturing the toner by mixing the external additive in the dried toner particles according to the necessity.

As the mixer for the external additive, mechanical type of mixers such as a Henschel mixer and a coffee mill may be used.

In the toner of the present invention, the median diameter ($D_{50}$) in the particle size distribution on a number basis of the toner particles composing the toner is preferably 3 through 9 μm.

Herein, the median diameter ($D_{50}$) of the toner particle is meant to a toner particle diameter equivalent to a portion to be a center value in a certain particle size distribution. Namely, when the particle size distribution of a certain number of toner particles is taken, the frequency is obtained by counting the number of the toner particles each to be a particle diameter in order from the largest to the smallest particle diameter or from the smallest to the largest particle diameter, and the toner particle diameter to be the particle size distribution portion showing 50% to all number of the toner particles is called as the median diameter ($D_{50}$).

In the toner of the present invention, the CV value in the particle size distribution on a number basis is preferably 20% or less.

The CV value in the particle size distribution on a number basis, which indicates the frequency of dispersion in the particle size distribution of the toner particles by the number basis, is determined by the following equation. The smaller the CV value is the particle size distribution is sharper, which means that the sizes of the toner particles are uniform with each other.

CV value=(Standard deviation in the number based particle size distribution)/(Median diameter ($D_{50}$) in the number based particle size distribution)×100

In the toner, the CV value is preferably adjusted in the range of 20.0 or less, more preferably in the range of 12.0 through 15.0.

The median diameter ($D_{50}$) and the CV value in the particle size distribution on a number basis of the toner particles are measured and calculated by using the equipment that computer system for data processing (manufactured by BECKMAN COULTER, Inc.) connected with COULTERMALTISIZER III (manufactured by BECKMAN COULTER, Inc.).

Measurement Conditions (1) Aperture: 50 μm (2) Sample preparation method: An adequate dose of the surface active agent (a mild detergent) is added to 50-100 ml of an electrolyte "ISOTON R-II" (manufactured by Coulter Scientific Japan Co., Ltd.) and stirred, in which 10-20 mg of a measurement sample is added. The resulting system is subjected to the dispersion treatment for one minute with the ultrasonic homogenizer to prepare the sample.

The particle size distribution of the toner particles can be controlled in accordance with the manufacturing conditions (for example, the composition of the resin (polymer), the flocculating agent used in the aggregation method, the organic solvent).

Further, as the toner, the fine powder toner quantity of 3.0 μm or less is equal to or smaller than 20% by number of the whole particle size distribution on a number basis, more preferably the fine powder toner quantity of 2.0 μm or less is 10% by number or less.

The toner of the present invention can be used as a black toner or a color toner.

Next, the compounds (the binder resin, colorant, releasing agent, charge control agent, external additive, lubricant) employed in the toner of the present invention will be described.

(Binder Resin)

Known resins may be used for the binder resin. More specifically, there may be used, for example, the styrene and copolymers of the substituent such as polystyrene, poly-p-chlorostyrene, polyvinyl toluene; the styrene based copolymers such as styrene-p-chlorostyrene copolymer, styrene-vinyl toluene copolymer, styrene-vinyl naphthalene copolymer, styrene-acrylic ester copolymer, styrene-methacrylic acid ester copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-acrylonitrile-indene copolymer; polyvinyl chloride, phenol resin, naturally modified phenol resin, natural resin modified maleic acid resin, acryl resin, methacrylic resin, polyvinyl acetate, silicon resin, polyester resin, polyurethane resin, polyamide resin, furan resin, epoxy resin, xylene resin, polyvinyl butyral resin, terpene resin, coumarone-indene resin, petroleum resin. Of these, the preferred binder resins may be the polyester resin and the styrene based copolymer resin.

Incidentally, listed as the monomer to be combined with the styrene monomer of the styrene based copolymer may be the monocarboxylic acid having double bond and its substituents such as acrylic acid, methyl acrylate, ethyl acrylate, butyl acrylate, dodecyl acrylate, octyl acrylate, acrylate-2-ethylhexyl, phenyl acrylate, methacrylic acid, methyl methacrylate, ethyl methacrylate, butyl methacrylate, octyl methacrylate, acrylonitrile, methacrylonitrile, acrylamide; the dicarboxylic acid having double bond and its substituents such as maleic acid, butyl maleate, methyl maleate, diethyl maleate; the vinylester such as polyvinyl chloride, vinyl acetate, vinyl benzoate; the ethylene olefin such as ethylene, propylene, butylenes; the vinyl ketone such as vinyl methyl ketone, vinyl hexyl ketone; and the vinyl ether such as vinyl methyl ether, vinyl ethyl ether, vinyl isobutyl ether. These vinyl based monomers are used alone or two or more of them are used as the monomers forming the copolymer.

Further, two or more of these resins may be mixed or cross-linked for use as the binder resin for the toner. As the cross-linking agent of the binder resin, a compound having double bond in which two or more monomers can be polymerized may be used. More specifically, the aromatic divinyl compounds such as divinyl benzene, divinyl naphthalene; the carboxylate ester having two or more double bonds such as ethylene glycol diacrylate, ethylene glycol dimethacrylate, 1,3-butadiol dimethacrylate; the divinyl compounds such as divinyl aniline, divinyl ether, divinyl sulfide, divinyl sulfone; and the compounds having three or more vinyl groups. These are used alone or two or more of them are used.

(Colorant)

The colorant used in the present invention may be known inorganic or organic colorants. Specific colorants are listed below.

As the black colorant, for example, the carbon blacks such as furnace black, channel black, acetylene black, thermal black, and lampblack, and also the magnetic powders such as magnetite and ferrite are used.

Listed as the colorant for magenta or red may be C. I. pigment red 2, C. I. pigment red 3, C. I. pigment red 5, C. I. pigment red 6, C. I. pigment red 7, C. I. pigment red 15, C. I. pigment red 16, C. I. pigment red 48; 1, C. I. pigment 53; 1, C. I. pigment 57; 1, C. I. pigment red 122, C. I. pigment red 123, C. I. pigment red 139, C. I. pigment red 144, C. I. pigment red 149, C. I. pigment red 166, C. I. pigment red 177, C. I. pigment red 178, C. I. pigment red 222 and the like.

Listed as the colorant for orange or yellow may be C. I. pigment orange 31, C. I. pigment orange 43, C. I. pigment yellow 12, C. I. pigment yellow 13, C. I. pigment yellow 14, C. I. pigment yellow 15, C. I. pigment yellow 17, C. I. pigment yellow 93, C. I. pigment yellow 94, C. I. pigment yellow 138 and the like.

Listed as the colorant for green or cyan may be C. I. pigment blue 15, C. I. pigment blue 15; 2, C. I. pigment blue 15; 3, C. I. pigment blue 15; 4, C. I. pigment blue 16, C. I. pigment blue 60, C. I. pigment blue 62, C. I. pigment blue 66, C. I. pigment green 7 and the like.

Incidentally, these colorants may be used alone or two or more of them may be selected and used together according to the necessity. The adding amount of the colorant is set to 1 through 30% by mass relative to the whole toner, and preferably in the range of 2 through 20% by mass.

(Releasing Agent)

Other releasing agent may be added in addition to the above ester compounds. As the other releasing agent, known compounds may be used, and more specifically, such as a solid paraffin wax, a micro wax, a rice wax, a fatty acid amide wax, a fatty acid wax, an aliphatic monoketone wax, a fatty acid metal salt wax, a fatty acid ester wax, a partial saponification fatty acid ester wax, a silicon varnish, a higher alcohol, and a carnauba wax.

Further, the polyolefin such as low-molecular weight polyethylene and polypropylene may also be used. Particularly, polyolefin having a softening point based on the ring-and-ball method is 70 through 150° C. is preferred, and polyolefin having a softening point of 120 through 150° C. is further preferred.

Incidentally, the content of the other releasing agent is preferably not more than 7 parts by mass relative to the whole toner. When the mass part is more than 7, the fixing performance under lower temperature may be damaged because of decreasing adhesion with the transfer material.

(Charge Control Agent)

In the toner of the present invention, a charge control agent may be added according to the necessity. As the charge control agent, known compounds may be used, and more specifically, a nigrosin dye, a metal salt of naphthenic acid or higher fatty acid, an alkoxylated amine, a quaternary ammonium chloride, an azo metal-complex, a salicylate metal salt or its metal-complex. Listed as the metal to be contained therein are Al, B, Ti, Fe, Co, Ni and the like. Particularly preferred compound as the charge control agent is the metal-complex compound of benzilic acid derivatives. Incidentally, when the content ratio of the charge control agent is preferably set to 0.1 through 20.0% by mass relative to the whole toner, good results may be obtained.

(External Additive)

An external additive may be mixed and used in the toner particles for the purpose of improving the charge property and increasing the cleaning property and other purposes. The external agent is not specifically limited and various types of inorganic fine particles, organic fine particles, and lubricants may be used.

As the inorganic fine particles, known particles may be used. More specifically, such fine particles of silica, titania, alumina, strontium titanate may preferably be used. These inorganic fine particles that are subjected to the hydrophobic treatment may be used according to the necessity. Listed as the specific silica fine particles may be, for example, the commercially available products manufactured by Nippon Aerosil Co., Ltd. such as R-805, R-976, R-974, R-972, R-812 and R-809; HVK-2150, H-200 manufactured by Hoechst Co., Ltd.; the commercially available products manufactured by Cabot Co., Ltd. such as TS-720, TS-530, TS-610, H-5, MS-5 and the like.

Listed as the titania fine particles may be, for example, the commercially available products manufactured by Nippon Aerosil Co., Ltd. such as T-805, T-604; the commercially available products manufactured by Tayca Co., Ltd. such as MT-100S, MT-100B, MT-500BS, MT-600, MT-600SS, JA-1; the commercially available products manufactured by Fuji Titan Co., Ltd. such as TA-300SI, TA-500, TAF-130, TAF-510, TAF-510T; the commercially available products manufactured by Idemitsu Co., Ltd. such as IT-S, IT-OA, IT-OB, IT-OC and the like.

Listed as the alumina fine particles may be, for example, commercially available products manufactured by Nippon Aerosil Co., Ltd. such as RFY-C, C-604; the commercially available product manufactured by Ishihara Sangyo Kaisha Ltd. such as TTO-55 and the like.

Further, as the organic fine particles, those having a number average primary particle diameter of about 10 through 2000 nm with a spherical shape may be used. More specifically, homopolymers such as styrene and methyl methacrylate and their copolymer may be used.

The adding amount of these external additives is preferably 0.1 through 10.0% by mass relative to the whole toner. As the method of adding the external additive, various types of known mixers may be used such as, a turbular mixer, a Henschel mixer, a nauter mixer, and a V-type mixer.

(Lubricant)

In the toner of the present invention, a lubricant may be mixed and used in the toner particles for the purpose of increasing the cleaning property and transfer property according to the necessity. Listed as the lubricant may be, for example, the metal salts of higher fatty acid such as the salts of zinc stearate, aluminum stearate, copper stearate, magnesium stearate, calcium stearate; the salts of zinc oleate, manganese oleate, iron oleate, copper oleate, magnesium oleate; the salts of zinc palmitate, copper palmitate, magnesium palmitate, calcium palmitate; the salts of zinc linoleate, calcium linoleate; the salts of zinc ricinoleate, calcium ricinoleate and the like.

The adding amount of these lubricants is preferably 0.1 through 10.0% by mass relative to the whole toner. As the method of adding the lubricant, various types of known mixers may be used such as a turbular mixer, a Henschel mixer, a nauter mixer, and a V-type mixer.

The toner of the present invention may be used as a mono-component developer or a two-component developer. When used as the mono-component developer, the toner may be formed as a magnetic mono-component developer in which magnetic particles of about 0.1 through 0.5 μm is contained in a non-magnetic mono-component developer or a toner, which can be used in either cases. Further, the toner may be used as the two-component developer by mixing with a carrier. In this case, as the magnetic particles of the carrier, known materials represented by magnetic particles containing iron such as iron, ferrite, and magnetite may be used, of these particularly preferred is the ferrite particle or the magnetite particle of the above carriers is preferably 15 through 100 μm, and more preferably 20 through 80 μm.

The measurement of the median diameter ($D_{50}$) in the particle size distribution on a volume basis of the carrier may be measured with a particle size distribution measuring machine of laser diffraction type "HELOS" (manufactured by Sympatec Co., Ltd.).

As the carrier, a coating carrier in which the magnetic particles are further coated with a resin, or a so-called resin dispersion type carrier in which the magnetic particles are dispersed in a resin is preferred. The resin composition for coating is not specifically limited, and such resins may be used including, for example, olefin resin, styrene resin, styrene-acrylic resin, silicon resin, ester resin or polymer resin containing fluorine. Further, the resin for composing the resin dispersion type carrier is not specifically limited and known resins may be used including, for example, styrene-acrylic resin, polyester resin, fluorine resin, phenol resin.

Further, the mixing ratio of the carrier and the toner is preferably in the range of carrier:toner=1:1 through 50:1 in the mass ratio.

The toner of the present invention is preferably used in an image forming apparatus based on the contact fixing method in which a transfer material with a toner image formed thereon is passed between heat members composing a fixing device to fix the image.

The image forming apparatus and the fixing device will be described below.

FIG. 1 is a cross-sectional view showing an example of an image forming apparatus used in the present invention.

In FIG. 1, reference numeral 1 denotes a semiconductor laser light source, reference numeral 2 denotes a polygon mirror, reference numeral 3 denotes an fθ lens, reference numeral 4 denotes a photoconductor drum, reference numeral 5 denotes a charger, reference numeral 6 denotes a development equipment, reference numeral 7 denotes a transfer equipment, reference numeral 9 denotes a separator (separating pole), reference sign P denotes a transfer material, reference numeral 10 denotes a fixing device, reference numeral 11 denotes a cleaning equipment, reference numeral 12 denotes an exposure before charge (PCL), reference numeral 13 denotes a cleaning blade.

The photoconductor drum 4 comprises an organic photoconductor (OPC) which is a photoconductor layer formed on an outer periphery of an aluminum-made drum substrate.

In FIG. 1, based on the information read out by an original reader not shown, an exposure light is emitted from the semiconductor laser light source 1. This emitted light is sorted in the direction perpendicular to a paper surface of FIG. 1 by the polygon mirror 2, and is irradiated on a surface of the photoconductor via the fθ lens 3 which corrects distortion of an image to create an electrostatic latent image. The photoconductor drum 4 is previously uniformly charged by the charger 5, and starts rotating in the clockwise direction in accordance with the timing of an image exposure.

The electrostatic latent image on the photoconductor drum surface is developed by the development equipment 6, and the developed image formed as described above is transferred on the transfer material P being fed in accordance with the timing by the action of the transfer equipment 7. Further, the photoconductor drum 4 and the transfer material P are separated by the separator (separating pole) 9, while the developed image is transferred and carried on the transfer material P, guided to the fixing device 10, fixed and then is fed outside the device.

The toner or other materials remaining on the photoconductor surface is cleaned by the cleaning equipment 11 of the cleaning blade system, and the remaining charge is eliminated in the exposure before charge (PCL) 12, and then the photoconductor is uniformly charged again by the charger 5 for the next image formation.

The transfer material used in the present invention is a support body for keeping the toner image, which is generally called as an image support body, a transfer body or a transfer sheet. More specifically, different types of transfer materials may be listed including plain papers from thin paper to thick paper, fine-quality paper, printing paper such as art paper and coated paper, Japanese paper and postcard paper which are commercially available, plastic film for OHP, and cloth, but the transfer material is not limited to these materials.

Further, a rubber-like elastic body of about 1 through 30 mm thickness is used for the cleaning blade 13, and polyurethane rubber is the most used as the material. This is used with being pressed and contacted against the photoconductor and can easily transfer heat, so that in the present-invention, a cancel mechanism is provided and the cleaning blade is desirably apart from the photoconductor during the image forming operation is not performed.

Figure 2:
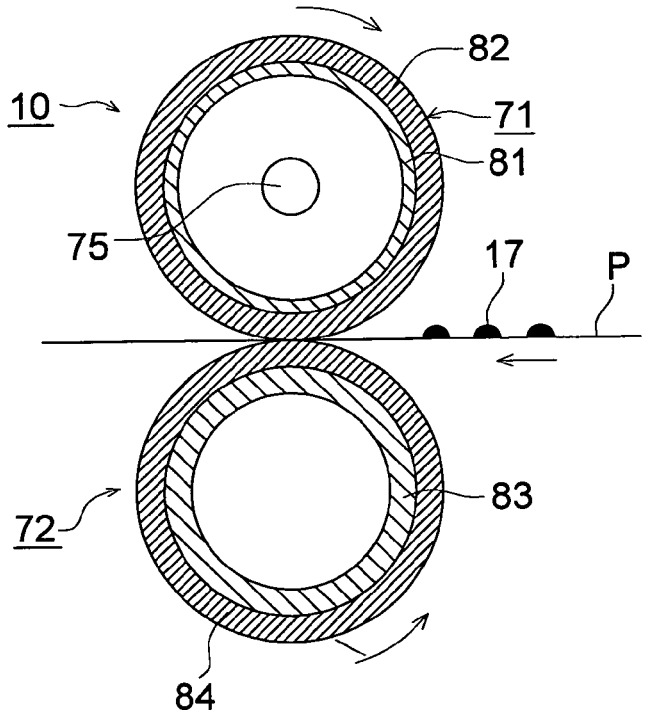
FIG. 2 is a cross-sectional view showing an example of a fixing device (of a type using a pressure roller and a heat roller) used in the present invention.

FIG. 2 is a cross-sectional view showing an example of the fixing device (a type of using a pressure roller and a heat roller) used in the present invention.

The fixing device 10 shown in FIG. 2 comprises a heat roller 71 and a pressure roller 72 abutting the heat roller 71. Incidentally, in FIG. 2, reference numeral 17 denotes a toner image formed on the transfer material P (transfer sheet).

The heat roller 71 comprises a coating layer 82 made of a fluorocarbon resin or an elastic body formed on a surface of a cored bar 81, the heat roller 71 further comprising a heat member 75 made of a linear heater.

The cored bar 81 is composed of a metal and the inner diameter thereof should be 10 through 70 mm. The metal composing the cored bar 81 is not specifically limited, and such metals may be listed including, for example, iron, aluminum, copper or alloys of these metals.

The wall thickness of the cored bar 81 should be 0.1 through 15 mm, which is determined considering the balance between the requirement of energy saving (making the wall thinner) and the strength (depending on the component materials). For example, in order to keep the strength equivalent to that of the cored bar made of iron of 0.57 mm by the cored bar made of aluminum, its thickness must be set to 0.8 mm.

As the fluorocarbon resin composing a surface of the coating layer 82, PTFE (polytetrafluoroethylene) and PFA (tetrafluoroetylene-perfluoro alkylvinylether copolymer) and the like may be listed.

The thickness of the coating layer 82 made of fluorocarbon resin should be 10 through 500 μm, and preferably 20 through 400 μm.

When the thickness of the coating layer 82 made of fluorocarbon resin is less than 10 μm, the function as the coating layer cannot be adequately performed, so that the durability as the fixing device cannot be assured. On the other hand, the surface of the coating layer over 500 μm is likely to have bruises due to paper powders, and the toner or other materials adheres at the bruise portions, causing the problem of image staining occurring.

Further, as the elastic body composing the coating layer 82, a silicon rubber and a silicon sponge rubber with good heat resistance such as LTV, RTV, HTV are preferably used.

An asker C hardness of the elastic body composing the coating layer 82 should be less than 80°, preferably less than 60°.

Further, the thickness of the coating layer 82 made of the elastic body is preferably 0.1 through 30 mm, more preferably 0.1 through 20 mm.

As the heat member 75, a halogen heater may preferably be used.

The pressure roller 72 comprises a coating layer 84 made of an elastic body formed on a surface of a cored bar 83. As the elastic body composing the coating layer 84 is not specifically limited, and various types of soft rubbers and sponge rubbers may be listed including polyurethane rubber and silicon rubber, and the silicon rubber and the silicon sponge rubber which were listed as the components of the coating layer 82 are preferably used.

Further, the thickness of the coating layer 84 is preferably 0.1 through 30 mm, and more preferably 0.1 through 20 mm.

Further, the fixing temperature (the surface temperature of the heat roller 10) is preferably 70 through 210° C., and the fixing linear velocity is preferably 80 through 640 mm/sec. The nip width of the heat roller is set to 8 through 40 mm, and preferably 11 through 30 mm.

Incidentally, the heat roller may be coated with a silicon oil of 0.3 mg per print or less, which may be also used oil-less.

Figure 3:
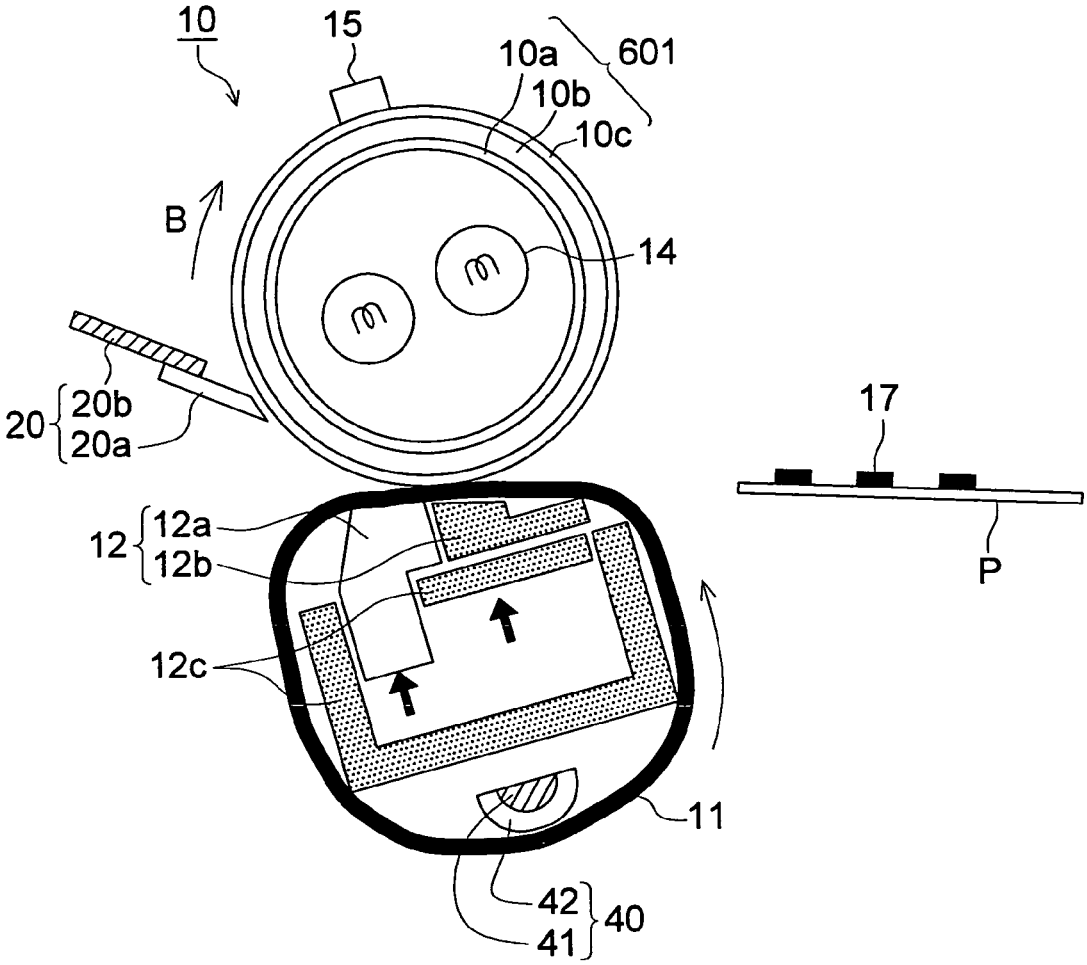
FIG. 3 is a general view showing an example of the fixing device (of a type using a belt and the heat roller) used in the present invention.

FIG. 3 is a general view showing an example of the fixing device (a type using a belt and a heat roller).

The fixing device shown in FIG. 3 is a type using a belt and the heat roller for keeping the nip width, wherein the key section is composed of a fixing roller 601 and a seamless belt 11, a pressure pads (pressure members) 12*a*, 12*b* which are pressed against the fixing roller 601 via the seamless belt 11, and a lubricant supplying member 40.

The fixing roller 601 comprises a heat resistance elastic body layer 10*b* and a releasing layer (heat resistance resin layer) 10*c* which are formed around a metal core (cylindrical cored bar) 10*a*, wherein inside the core 10*a* is provided with the halogen lamp as the heat source. The temperature of a surface of the fixing roller 601 is measured with the temperature sensor 15, and the halogen lamp is feedback-controlled by a temperature controller not shown in response to the measured signal, thereby the surface of the fixing roller 601 is controlled so that the temperature thereof is constant. The seamless belt 11 is contacted as to be wound by a prespecified angle relative to the fixing roller 601 to form a nip section.

Inside the seamless belt 11 is provided with a pressure pad 12 having a low friction layer on a surface thereof in the state of being pressed against the fixing roller 601 via the seamless belt 11. The pressure pad 12 is provided with the pressure pad 12*a* to which a strong nip pressure is applied and the pressure pad 12*b* to which a weak nip pressure is applied, the pressure pads 12*a*, 12*b* being held by a holder 12*c* made of metal or other materials.

The holder 12*c* is further mounted with a belt-travel guide so that the seamless belt 11 can slide and rotate smoothly. Because the belt-travel guide chafes against an inner surface of the seamless belt 11, a member for the belt-travel guide is desired to have a lower friction coefficient and also has a low heat conduction so as to be hard to take the heat away from the seamless belt 11. Incidentally, a specific example of the belt member of the seamless belt may be that made of polyimide.

The lubricant supplying member 40 includes a lubricant holding member 41 and a lubricant transmission controlling film 42. The lubricant holding member 41 which has a plurality of continues porous includes felt and sponge. The lubricant holding member 41 is immersed with lubricant including silicone oil and fluorine oil. The lubricant transmission controlling film 42 which has a plurality of continues porous includes an oriented film of fluorine resin. Incidentally; a releasing member 20 as supporting member for releasing can be provided on downstream of the nip section of the fixing roller 601 to form a nip section.

The releasing member 20 is hold by holder 20*b* so that a releasing baffle 20*a* faces against rotating direction of the fixing roller 601 and is close to the fixing roller 601.

Figure 4:
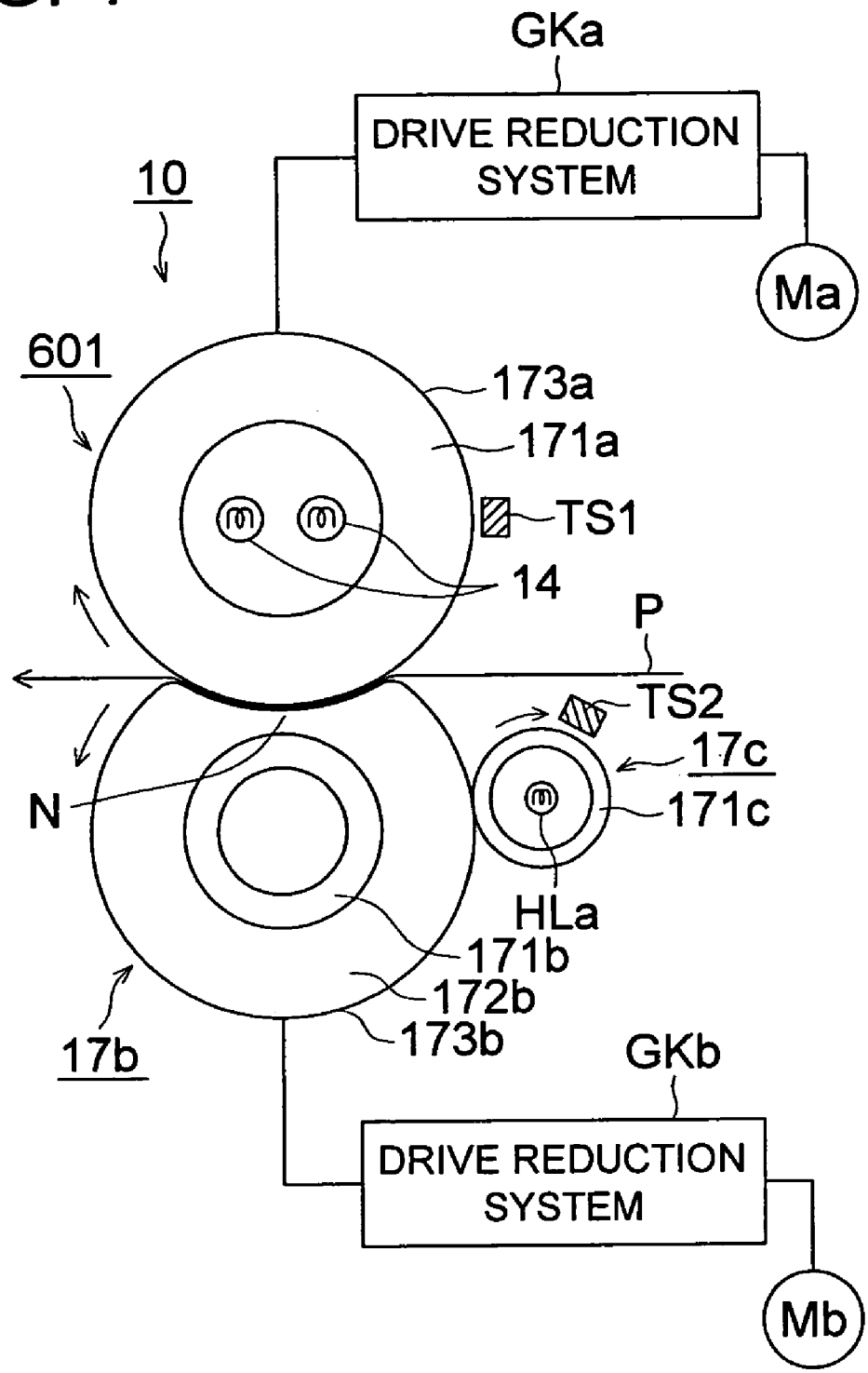
FIG. 4 is a general view showing an example of the fixing device (of a type using a soft roller and the heat roller) used in the present invention.

FIG. 4 is a general view showing an example of the fixing device (a type using a soft roller and a heat roller) used in the present invention.

The fixing device 10 shown in FIG. 4 is the type using the soft roller and the heat roller which ensure a fixing nip and prevent the transfer material from winding with excellent image quality, the fixing device using a heat roller 601 as the heat roller member and a pressing roller 17*b* as the soft roller member and comprising the halogen lamp as the heat member inside the heat roller 601.

In the fixing device 10, a nip section N is formed between the heat roller 601 and the pressing roller 17*b*, and when heat and pressure are applied through the nip section N, a toner image is fixed on the transfer material P. In the above case, the halogen lamp (not shown) as the heat member may also be provided inside the pressing roller 17*b* as soft roller.

The heat roller 601 including a halogen heater 14 inside as heating device is a hard roller having a major diameter of 50 to 80 mm. The hard roller has a metal base and a releasing layer provided thereon, wherein the metal base is, for example, a cylindrical metal pipe 171*a* made of aluminum and having a wall thickness of 5 to 20 mm, and the releasing layer 173*a* coated on the surface of the metal pipe 171*a* can be made by coating with PFA (perfluoroalkoxy) coating or tube and has a thickness of 5 to 30 μm.

The heat roller 601 is independently driven by actuating motor Ma through to a drive reduction system Gka.

The pressing 17*b* as pressing device has a major diameter of 50 to 80 mm. The soft roller has a metal base and provided thereon, a rubber roller layer and a releasing layer, wherein the metal base is, for example, a cylindrical metal pipe 171*b* as core metal made of iron and having a wall thickness of 5 to 10 mm, wherein the rubber roller layer 172*b* coated on the surface of the metal pipe 171*b* has a thickness of 3 to 15 mm and a rubber strength of 30 Hs to 50 Hs (A-type rubber strength in JIS), and can be made of silicone, and wherein the releasing layer 173*b* coated on the surface of the rubber layer 172*b* can be made by coating with PFA The pressing roller 17*b* is also independently driven by actuating motor Mb through a drive reduction system Gkb.

On a circumference of the pressing roller 17*b*, a fixing supporting roller 17*c* having a halogen lamp Hla inside as a heating means is provided on the upstream of nip section N of the heat roller 601 and the pressing roller 17*b*.

The fixing supporting roller 17*c* has a metal pipe 171*c* and a halogen lamp Hla, wherein the metal pipe 171*c* is a cylindrical core metal having a major diameter of 1 to 3 mm and provided thereon PFA (perfluoroalkoxy), and wherein the halogen lamp Hla is provided inside of the metal pipe 171*c*.

The fixing supporting roller 17*c* is driven by rotating of the pressing roller 17*b* in condition of the an un-shown spring of the soft roller pushing the fixing supporting roller 17*c*.

The toner image or the toner color image on the recording paper (transfer material P) is fixed on the nip section N formed between the heat roller 601 which is a hard roller and the pressing roller 17*b* which is a soft roller.

A temperature sensor TS1 is contacted or non-contacted with the heat roller 601 to control a temperature of the heat roller 601. A temperature sensor TS2 is contacted or non-contacted with the fixing supporting roller 17*c*.

EXAMPLES

The present invention will be specifically described with reference to examples. However, the embodiments of the present invention are not to be construed as being limited to these examples.

<Production of Ester Compounds Having a Specific Structure>

Polyvalent carboxylic acid and long-chain aliphatic alcohol having 10 through 30 carbon atoms were subjected to the dehydration and condensation reaction to produce compounds (1), (4), (6), (7), (8), (9), (10), (13) and (15).

The reaction was carried out under nitrogen atmosphere at 220° C. for 8 hours, and after the reaction was completed, the resulting system was cooled down to 80° C. at a cooling speed of 20° C./min, being subjected to the neutralization reaction in the potassium hydrate solution, and then subjected to cleaning, dehydration, and filtering to obtain the above compounds.

<Production of Toners>

(Production of Toner Particle 1)

(1) Synthesis of low-molecular weight latex: Charged into a 1 liter four-flask equipped with a mixer, a cooling tube and a temperature sensor were 509.83 g of styrene, 88.67 g of n-butyl acrylate, 34.83 g of methacrylic acid, 21.83 g of tert-dodecyl mercaptan, and 66.7 g of the compound (8), with the inner temperature raised to 80° C., the contents of the flask were stirred until the compound (8) was dissolved and then the temperature was kept constant. While, surface active agent solution in which 1.0 g of dodecyl sodium benzenesulfonate was dissolved in 2700 ml of deionized water was similarly heated so that the inner temperature was to 80° C. and kept untouched. With stirring the surface active agent solution kept at 80° C. was added with the monomer solution with the compound (8) dissolved therein, and the resulting solution was emulsified using an ultrasonic emulsifying device to obtain an emulsified liquid. Next, charged into a 5-liter four-flask equipped with a mixer, a cooling tube, a nitrogen introduction tube and a temperature sensor was the emulsified liquid, and under a flow of nitrogen with the inner temperature thereof kept to 70° C., and the content of the flask was added with polymerization initiator solution in which 7.52 g of ammonium persulfate was dissolved in 500 ml of deionized waster with stirring, and the resulting solution was polymerized for 4 hours, followed by cooled down to a room temperature and filtered to obtain a latex. After the reaction, the polymerization residue was not observed and stable latex could be obtained. This will be represented as "latex (L-1)".

For the obtained "latex (L-1)", the number average primary particle diameter was measured using an electrophoresis light scattering photometer "ELS-800" (manufactured by Otsuka Electronics Co., Ltd.) and the result was 125 nm. The glass transition temperature was measured by DSC and the result was 58° C. Further, the solid content density of the above latex measured based on the mass method by the rack drying was 20% by mass.

(2) Synthesis of large molecular weight latex: Charged into a 500 ml four-flask equipped with a mixer, a cooling tube and a temperature sensor were 92.47 g of styrene, 30.4 g of n-butyl acrylate, 3.80 g of methacrylic acid, 0.12 g of tert-dodecyl mercaptan, and 13.34 g of the compound (8), with the inner temperature raised to 80° C., the contents of the flask were stirred until the compound (8) was dissolved and then the temperature was kept constant. While, surface active agent solution in which 0.27 g of dodecyl sodium benzenesulfonate was dissolved in 540 ml of deionized water was similarly heated so that the inner temperature was to 80° C. and kept untouched. With stirring the surface active agent solution kept at 80° C. was added with the monomer solution with the compound (8) dissolved therein, and the resulting solution was emulsified using the ultrasonic emulsifying device to obtain an emulsified liquid. Next, charged into a 5-liter four-flask equipped with a mixer, a cooling tube, a nitrogen introduction tube and a temperature sensor was the emulsified liquid, and under a flow of nitrogen with the inner temperature thereof kept to 70° C., the content of the flask was added with polymerization initiator solution in which 0.27 g of ammonium persulfate was dissolved in 100 ml of deionized waster with stirring, and the resulting solution was polymerized for 4 hours followed by cooled down to a room temperature and filtered to obtain a latex. After the reaction, the polymerization residue was not observed and stable latex could be obtained. This will be represented as "latex (H-1)".

For the obtained "latex (H-1)", the number average primary particle diameter was measured using the electrophoresis light scattering photometer "ELS-800" (manufactured by Otsuka Electronics Co., Ltd.) and the result was 108 nm. The glass transition temperature was measured by DSC and the result was 59° C. Further, the solid content density of the latex measured based on the mass method by the rack drying was 20% by mass.

(3) Production of toner particles: Charged into a 5-liter four-flask equipped with a mixer, a cooling tube and a temperature sensor were 250 g of the latex (H-1), 1000 g of the latex (L-1), 900 ml of deionized water, and a carbon black dispersion comprising 20 g of carbon black "REGAL 330R" (manufactured by Cabot Corporation) dispersed in a surface active agent solution (a solution in which 9.2 g of dodecyl sodium sulfate was dissolved in 160 ml of deionized water), and with stirring the contents of the flask were added with 5N sodium hydroxide solution to adjust the pH to 10. Further, with stirring the resulting solution was added with a solution with 28.5 g of magnesium chloride 6-hydrate dissolved in 1000 ml of deionized water under the room temperature, in which the inner temperature was raised to 95° C. With the inner temperature kept at 95° C., the median diameter ($D_{50}$) on a volume basis was measured using "COULTERMALTISIZER III" (manufactured by BECKMAN COULTER, Inc.), and at the time when the particle diameter was 6.5 μm, a solution with 80.6 g of sodium chloride dissolved in 700 ml of deionized water was added to cause the reaction to continue for 6 hours with the inner temperature kept at 95° C. After the reaction was completed, the obtained dispersion of the associated particles (95° C.). was cooled for 10 minutes to 45° C. (cooling speed=5° C./min.). The associated particles (toner particles) produced as described above were filtered, cleaned through repeating resuspension to deionized water and filtering, and then dried to obtain toner particles. This will be represented as "toner particle 1". The median diameter and CV value of "toner particle 1" were measured under the above conditions, and the results were as follows: median diameter ($D_{50}$)=6.5 μm, CV value=18.2%.

(Production of Toner Particle 2)

"Toner particle 2" was produced in the same manner except that 66.7 g of the compound (8) used in the production of the toner particle 1 was changed to 100.0 g.

(Production of Toner Particle 3)

"Toner particle 3" was produced in the same manner except that 66.7 g of the compound (8) used in the production of the toner particle 1 was changed to 20.0 g.

(Production of Toner Particle 4)

"Toner particle 4" was produced in the same manner except that the compound (8) used in the production of the toner particle 1 was changed to the compound (10).

(Production of Toner Particle 5)

"Toner particle 5" was produced in the same manner except that the compound (8) used in the production of the toner particle 1 was changed to the compound (4).

(Production of Toner Particle 6)

"Toner particle 6" was produced in the same manner except that the compound (8) used in the production of the toner particle 1 was changed to the compound (1).

(Production of Toner Particle 7)

"Toner particle 7" was produced in the same manner except that the compound (8) used in the production of the toner particle 1 was changed to the compound (6).

(Production of Toner Particle 8)

"Toner particle 8" was produced in the same manner except that the compound (8) used in the production of the toner particle 1 was changed to the compound (7).

(Production of Toner Particle 9)

"Toner particle 9" was produced in the same manner except that the compound (8) used in the production of the toner particle 1 was changed to the compound (9).

(Production of toner Particle 10)

"Toner particle 10" was produced in the same manner except that the compound (8) used in the production of the toner particle 1 was changed to the compound (13).

(Production of Toner Particle 11)

"Toner particle 11" was produced in the same manner except that the compound (8) used in the production of the toner particle 1 was changed to the compound (15).

(Production of Toner Particle 12)

"Toner particle 12" was produced in the same manner except that the compound (8) used in the production of the toner particle 1 was changed to the comparative compound (1).

Comparative compound (1)

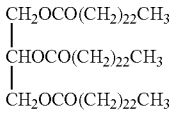

(Production of Toner Particle 13)

"Toner particle 13" was produced in the same manner except that the compound (8) used in the production of the toner particle 1 was changed to the comparative compound (2).

Comparative compound (2)

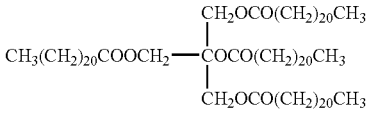

(Production of Toner Particle 14)

"Toner particle 14" was produced in the same manner except that the compound (8) used in the production of the toner particle 1 was changed to the comparative compound (3).

Comparative compound (3)

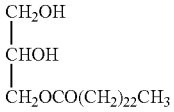

(Production of toner Particle 15)

"Toner particle 15" was produced in the same manner except that compound (6) used in the production of the toner particle 1 was changed to the carnauba wax.

(Production of Toner Particle 16)

"Toner particle 16" was produced in the same manner except that the compound (8) used in the production of the toner particle 1 was changed to the comparative compound (4).

Comparative compound (4)

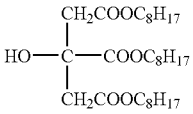

(Production of Toner Particle 17)

"Toner particle 17" was produced in the same manner except that the compound (8) used in the production of the toner particle 1 was changed to the comparative compound (5).

Comparative compound (5)

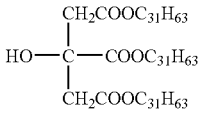

(Production of Toner Particle 18)

"Toner particle 18" was produced in the same manner except that the compound (8) used in the production of the toner particle 1 was changed to the comparative compound (6).

Comparative compound (6)

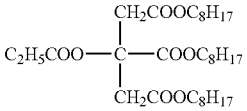

(Production of Toner Particle 19)

"Toner particle 19" was produced in the same manner except that the compound (8) used in the production of the toner particle 1 was changed to the comparative compound (7).

Comparative compound (7)

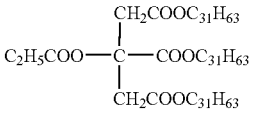

(Production of Toner Particle 20)

"Toner particle 20" was produced in the same manner except that the compound (8) used in the production of the toner particle 1 was changed to the comparative compound (8).

Comparative compound (8)

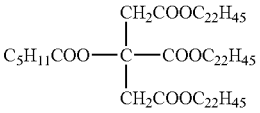

The ester compounds having the specific structure, their quantities, median diameters ($D_{50}$) on a number basis of the toner particles, and CV values which were used in the production of the toner particles are shown in Table 1.

TABLE 1

| Toner particle | Ester compound having specific structure | | Median diameter ($D_{50}$) | CV value |
|---|---|---|---|---|
| No. | Compound | Quantity (g) | (μm) | (%) |
| 1 | (8) | 66.7 | 6.4 | 18.2 |
| 2 | (8) | 100.0 | 6.6 | 17.8 |
| 3 | (8) | 20.0 | 6.4 | 18.5 |
| 4 | (10) | 66.7 | 6.5 | 18.1 |
| 5 | (4) | 66.7 | 6.3 | 18.3 |
| 6 | (1) | 66.7 | 6.5 | 18.0 |
| 7 | (6) | 66.7 | 6.3 | 18.0 |
| 8 | (7) | 66.7 | 6.4 | 18.2 |
| 9 | (9) | 66.7 | 6.4 | 17.9 |
| 10 | (13) | 66.7 | 6.6 | 17.8 |
| 11 | (15) | 66.7 | 6.5 | 18.3 |
| 12 | Comparative compound(1) | 66.7 | 6.2 | 17.8 |
| 13 | Comparative compound(2) | 66.7 | 6.6 | 17.5 |
| 14 | Comparative compound(3) | 66.7 | 6.4 | 17.9 |
| 15 | Carnauba wax | 66.7 | 6.5 | 17.6 |
| 16 | Comparative compound(4) | 66.7 | 6.5 | 18.1 |
| 17 | Comparative compound(5) | 66.7 | 6.3 | 18.0 |

TABLE 1-continued

| Toner particle | Ester compound having specific structure | | Median diameter ($D_{50}$) | CV value |
|---|---|---|---|---|
| No. | Compound | Quantity (g) | (μm) | (%) |
| 18 | Comparative compound(6) | 66.7 | 6.6 | 17.7 |
| 19 | Comparative compound(7) | 66.7 | 6.4 | 18.2 |
| 20 | Comparative compound(8) | 66.7 | 6.5 | 18.3 |

(External Additive Treatment of the Toner Particles)

Next, each of the "toner particles 1 through 20" produced as described above was added with 1% by mass of hydrophobic silica (the number average primary particle diameter=12 nm, the hydrophobic ratio=68) and 1% by mass of hydrophobic titanium oxide (the number average primary particle diameter=20 nm, the hydrophobic ratio=63), and was mixed using "HENSCHEL MIXER" (manufactured by Mitsui Miike Co., Ltd.). Subsequently, coarse particles were removed using a sieve of 45 μm opening to prepare "toners 1 through 20". These will be represented as "Examples 1 through 11 or Ex. 1 through 11" and "comparative examples 1 through 9 or Comp. 1 through 9".

<Preparation of Developers>

Each of the "toners 1 through 20" produced as described above was mixed with a ferrite carrier coated with silicon resin and having median diameters ($D_{50}$) on a volume basis of 60 μm so that the density of each of the toners was to 6% by mass to prepare "developers 1 through 20".

<Evaluation Device>

The fixing device in FIG. 3 was mounted to the image forming apparatus described in FIG. 1 to use as the evaluation device. Incidentally, the fixing speed and the transfer material surface temperature were designed to be set as described below.

Fixing speed: arbitrary settable in the range of 80 through 280 mm/sec (about 50 sheets/minute)

Transfer material surface temperature: arbitrary settable in the range of 90 through 240° C.

<Evaluation>

Using the above evaluation device, each of the toners and each of the developers were sequentially filled to carry out printing, and the evaluation was made about the following items.

<<Evaluation of the Fixable Temperature Area>>

The temperature of the transfer material immediately after discharged from the heat roll was varied from 90° C. through 200° C. at every 10° C. to produce fixed images. Incidentally, A4-size fine-quality paper (65 g/m$^2$) was used as the transfer material.

The fixable temperature area was provided from the fixing strength of the obtained fixed images which was measured using a method in accordance with a mending tape stripping method described in "DENSHISYASHIN GIJYUTSU NO KISO TO OUYOU (Base and Application of Electrophotographic Technology): edited by Imaging Society of Japan" Chapter 9, Section 1.4. More specifically, the transfer material surface temperature was varied, and for each of the temperatures, a 2.54 cm square solid fixed image with the toner adhesion of 0.6 mg/cm$^2$ was produced, and the image densities of before and after the image was stripped by "Scotch Mending Tape" (manufactured by Sumitomo 3M Co., Ltd.) were measured, and then the residual ratio of the image density was obtained as the fixing ratio.

The evaluation made by assuming that the fixing temperature with the obtained fixing ratio of 90% or more was the fixable temperature and the fixable temperature range was equal to the fixable temperature area. Incidentally, a reflection density meter "RD-918" (manufactured by Macbeth Co., Ltd.) was used for the measurement of the image densities.

Evaluation Criteria

A: When the fixable temperature range is 100° C. or more, the fixable temperature area is wide and excellent.

B: When the fixable temperature range is 70° C. or more, the fixable temperature area is wide and good.

C: When the fixable temperature range is 40° C. or more, the fixable temperature area becomes narrower but no problem in practical application.

D: When the fixable temperature range is less than 40° C., the fixable temperature area is narrow.

<<Fixing Offset Evaluation>>

Under low-temperature and low-humidity (10° C., 20% RH) environment, the continuous printing was carried out on 1000 sheets of A3-size fine-quality paper (65 g/m$^2$) with humidity controlled in the same environment, and a visual observation was made directly on the images and the heat roll surface after completion of the 1000-sheet printing and an evaluation was made from the degree of the toner adhesion generated on the printed images and the heat roll surface.

Evaluation Criteria

A: No offset occurrence is observed neither on the images nor the heat roll surface and good.

B: Offset occurs on the heat roll but not on the images, presenting no problem in practical application.

D: Stains due to offset occurs on the images.

<<Fixing Strength Evaluation>>

The fixing strength was evaluated by the tape stripping test.

Solid images having the initial density in the range of 1.0 through 1.2 were printed by setting the fixing speed to 80 mm/sec and the surface temperature of the transfer material to 100° C. "Mending Tape" (manufactured by Sumitomo 3M Co., Ltd.) was applied on each of the solid images, and the image density of a portion in which the mending tape was stripped was measured, and then the ratio between the initial image density and the latter density was calculated to evaluate as the fixing strength based on the tape stripping method. Incidentally, the reflection density meter "RD-918" (manufactured by Macbeth Co., Ltd.) was used for the measurement of the image densities.

Tape Stripping Method (1) Measuring the absolute reflection density $D_0$ of a 5 mm square black solid.

(2) Lightly applying "Mending Tape" (equivalent to No. 810-3-12, manufactured by Sumitomo 3M Co., Ltd.).

(3) Rubing the tape 3.5 times in both ways with the pressure of 1 kPa.

(4) Striping the tape at the angle of 180° and with the strength of 200 g.

(5) Measuring the absolute reflection density $D_1$ after stripping.

(6) Fixing strength=$100\times D_1/D_0$ (%)

Evaluation Criteria

A: The fixing strength is 95% or more and good

B: The fixing strength is 90% or more and no problem in practical application

D: The fixing strength is less than 90%.

<<Image Evaluation>>

Using A3-size fine-quality paper (65 g/m$^2$), 500000 sheets were intermittently copied with the heat roll surface temperature set to 150° C. so that the fixing speed is 280 mm/sec and the surface temperature of the transfer material is 100° C., followed by remaining untouched for 24 hours and the densities and fogs of the first printed and the continuous 100th printed images were evaluated.

<Image Density>

The density of the black solid image portion was evaluated based on the relative density (the density of the transfer material without being printed was assumed to be 0.0). Incidentally, the reflection density meter "RD-918" (manufactured by Macbeth Co., Ltd.) was used for the measurement.

Evaluation Criteria

A: The black solid densities in both of the first and 100th sheets are over 1.2 and good.

B: The black solid density in the first sheet is 1.2 through 0.8 and slightly pale but on the level of no problem in practical application.

D: The black solid densities in both of the first and 100th sheets are less than 0.8.

<Fog>

The fog density was measured by assuming that when the white background portion of unused transfer material was to the reflection density 0.000, the fog density of the white portion of the print was equal to the relative density. Incidentally, the reflection density meter "RD-918" (manufactured by Macbeth Co., Ltd.) was used for the measurement.

Evaluation Criteria

A: The relative densities in both of the first and 100th sheets are less than 0.002 and no problem in fog.

B: The relative density in the first sheet is 0.002 through 0.005 and the relative density in the 100th sheet is 0.002 or less, in which some fog is observed but no problem in practical application.

D: The relative densities in both of the first and 100th sheets are over 0.005 with gross fog.

The evaluation results are shown in Table 2.

TABLE 2

| | Toner particle No. | Fixable temperature area | Fixing offset | Fixing strength | Image density | Fog |
|---|---|---|---|---|---|---|
| Ex. 1 | 1 | A | A | A | A | A |
| Ex. 2 | 2 | A | A | B | A | A |
| Ex. 3 | 3 | B | B | A | A | A |
| Ex. 4 | 4 | A | A | A | A | A |
| Ex. 5 | 5 | A | A | A | A | A |
| Ex. 6 | 6 | B | B | A | B | B |
| Ex. 7 | 7 | B | B | A | B | B |
| Ex. 8 | 8 | B | B | A | B | B |
| Ex. 9 | 9 | B | B | A | B | B |
| Ex. 10 | 10 | B | B | B | B | B |
| Ex. 11 | 11 | B | B | B | B | B |
| Comp. 1 | 12 | B | D | D | D | D |
| Comp. 2 | 13 | B | D | D | D | D |
| Comp. 3 | 14 | D | D | D | D | D |
| Comp. 4 | 15 | D | D | D | B | B |
| Comp. 5 | 16 | D | D | B | D | D |

TABLE 2-continued

| | Toner particle No. | Fixable temperature area | Fixing offset | Fixing strength | Image density | Fog |
|---|---|---|---|---|---|---|
| Comp. 6 | 17 | D | D | B | D | B |
| Comp. 7 | 18 | D | D | B | D | D |
| Comp. 8 | 19 | D | D | B | D | B |
| Comp. 9 | 20 | D | B | D | D | D |

As is apparent from Table 2, although Ex.s 1 through 11 were excellent in every evaluation item, it can be found that the comparative examples 1 through 9 had problems in several evaluation items.

What is claimed is:

1. A toner for developing an electrostatic image, the toner comprising a compound represented by a following formula (1):

formula (1)

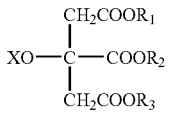

wherein X represents H or —CO—$R_4$; $R_4$ represents an alkyl group having 1 to 4 carbon atoms and the alkyl group may have a substituent; $R_1$ though $R_3$ independently represent an alkyl group having 10 to 30 carbon atoms and the alkyl group may have a substituent; and $R_1$ though $R_3$ may be either the same or different; and the toner has a median diameter ($D_{50}$) in particle size distribution on a number basis within the range of 3 to 9 μm.

2. The toner of claim 1, wherein the content ratio of the compound represented by the formula (1) is 1 to 15 parts by mass relative to 100 parts by mass of the toner.

3. The toner of claim 1, wherein the content ratio of the compound represented by the formula (1) is 3 to 12 parts by mass relative to 100 parts by mass of the toner.

4. The toner of claim 1, wherein a CV value in the particle size distribution on a number-basis of the toner is 12.0 to 15.0%.

5. The toner of claim 1, wherein the compound comprising at least one of compounds of (1) to (15):

(1)

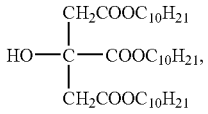

(2)

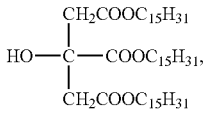

(3)

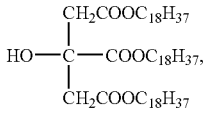

-continued (4)

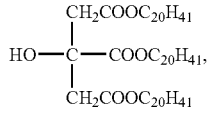

(5)

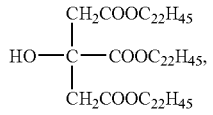

(6)

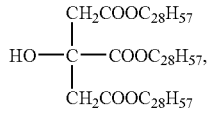

(7)

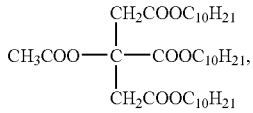

(8)

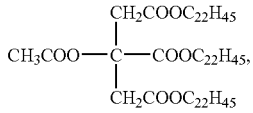

(9)

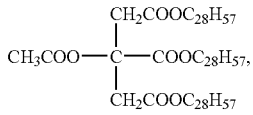

(10)

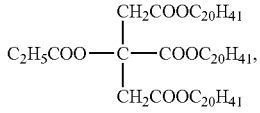

(11)

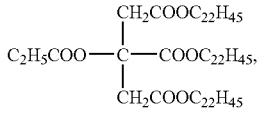

(12)

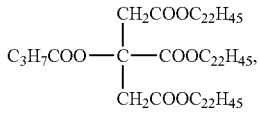

(13)

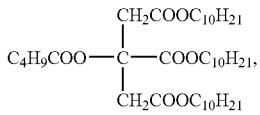

(14)

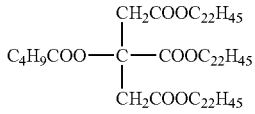

and (15)

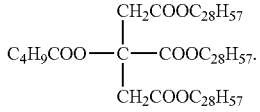

6. The toner of claim 5, wherein the content ratio of the compound represented by the formula (1) is 3 to 12 parts by mass relative to 100 parts by mass of the toner, and the toner has a median diameter ($D_{50}$) in particle size distribution on a number basis within the range of 3 to 9 μm.

7. An image forming method comprising: fixing a toner image formed by a toner as defined in claim 1.

8. The method of claim 7, wherein the fixing comprises: passing the toner image between a fixing member having a heating member and pressing member.

9. The method of claim 8, wherein each of the fixing member and the pressing member has a support and a layer having thickness in the range of 0.1 to 30 mm.

10. The method of claim 8, wherein the fixing is carried out at the temperature of surface of the fixing member in the range of 70 to 210° C.

11. The method of claim 7, wherein the content ratio of the compound represented by the formula (1) is 1 to 15 parts by mass relative to 100 parts by mass of the toner.

12. The method of claim 7, wherein the content ratio of the compound represented by the formula (1) is 3 to 12 parts by mass relative to 100 parts by mass of the toner.

13. The method of claim 7, wherein the toner has a median diameter ($D_{50}$) in particle size distribution on a number basis within the range of 3 to 9 μm.

14. The method of claim 7, wherein the toner has a CV value in the particle size distribution on a number basis of 12.0 to 15.0%.

* * * * *